US006644946B2

(12) United States Patent
Nakane et al.

(10) Patent No.: US 6,644,946 B2
(45) Date of Patent: Nov. 11, 2003

(54) SCROLL TYPE COMPRESSOR

(75) Inventors: Yoshiyuki Nakane, Kariya (JP); Takahiro Moroi, Kariya (JP); Ryuta Kawaguchi, Kariya (JP); Tsutomu Nasuda, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/054,112

(22) Filed: Jan. 22, 2002

(65) Prior Publication Data

US 2002/0110470 A1 Aug. 15, 2002

(30) Foreign Application Priority Data

Jan. 22, 2001 (JP) ..... 2001-013272

(51) Int. Cl.[7] ..... F01C 1/02
(52) U.S. Cl. ..... 418/55.1; 418/83
(58) Field of Search ..... 418/55.1, 83

(56) References Cited

U.S. PATENT DOCUMENTS 5,247,738 A * 9/1993 Yoshii ..... 418/55.1
5,622,487 A * 4/1997 Fukuhara et al. ..... 418/83
5,775,888 A * 7/1998 Sakamoto et al. ..... 418/101
6,146,575 A * 11/2000 Huston ..... 418/55.1

FOREIGN PATENT DOCUMENTS

JP 62265487 A * 11/1987 ..... F04C/23/02
JP 04342801 A * 11/1992 ..... F01C/1/02
JP 05010281 A * 1/1993 ..... F04C/29/00
JP 05033784 A * 2/1993 ..... F04C/18/02
JP 06159267 A * 6/1994 ..... F04C/18/02
JP 8-247056 9/1996 ..... F04C/18/02

* cited by examiner

*Primary Examiner*—Thomas Denion
*Assistant Examiner*—Theresa Trieu
(74) *Attorney, Agent, or Firm*—Morgan & Finnegan, LLP

(57) ABSTRACT

A scroll type compressor has a housing, a drive shaft, a fixed scroll member, a movable scroll member, a suction port and a discharge port. The drive shaft is rotatably supported by the housing. The fixed scroll member is fixed to the housing. The movable scroll member is accommodated in the housing, and the faces the fixed scroll member. The housing and the fixed scroll member define a cooling region. The fixed scroll member and the movable scroll member define a compression region. The suction port introduces gas into the compressor. The discharge port discharges the gas. Heat resistant means is disposed at least between the cooling region and the compression region. Heat resistance of the heat resistant means adjacent to the outermost compression region is greater than that of the heat resistant means adjacent to the innermost compression region.

10 Claims, 6 Drawing Sheets

SCROLL TYPE COMPRESSOR

BACKGROUND OF THE INVENTION

The present invention relates to a scroll type compressor, especially to a scroll type compressor that compresses gas to supply to a fuel cell.

There are compressors of various types, e.g. a screw type compressor, a rotary type compressor and a scroll type compressor. Particularly, the scroll type compressor is small and light, and generates less vibration and less noise. Therefore, the scroll type compressor is widely used for freezing and air-conditioning. The scroll type compressor produces heat in compression cycle. In a prior art as described in Japanese Unexamined Patent Publication No. 8-247056, a cooling chamber is provided around a discharge port to cool discharge gas.

FIG. 7 is a longitudinal cross-sectional view of a conventional scroll type compressor. A housing of the conventional compressor 100 is constituted of a front casing 101, an end plate 102 and a rear casing 103. The end plate 102 is connected to the front casing 101 on the side of a discharge port 104. The rear casing 103 is connected to the front casing 101 on the side of a motor. The discharge port 104 is formed through the center of the end plate 102. A cooling chamber 120 is defined between the front casing 101 and the end plate 102. A fixed scroll wall 105 extends from a fixed scroll base plate 107 of the front casing 101 toward the side of the motor. Meanwhile, one end of a crank shaped drive shaft 109, which is connected to a drive shaft of the motor, is rotatably arranged on the motor side of the rear casing 103. A movable scroll wall 110 extends from a movable scroll base plate 111 toward the side of the discharge port. Compression chambers 106 are defined between the fixed scroll wall 105 and the movable scroll wall 110. A discharge valve 108 separates the compression chambers 106 from the discharge port 104.

As the drive shaft 109 rotates due to rotation of the motor, the movable scroll wall 110 orbits. Gas, such as air, in the compression chambers 106 is radially inwardly moved toward the innermost compression chamber 106 as is compressed. The gas heats in compression cycle. The compressed gas is discharge to the discharge port 104 via the discharge valve 108, then outside the compressor 100.

Cooling water flows into a cooling chamber 120 via a coolant inlet, which is not shown. The cooling chamber 120 is defined in the vicinity of the compression chambers 106 and the discharge port 104. Therefore, the heat generated by compressing the gas in the compression chambers 106 and the heat of the compressed gas in the discharge port 104 conduct to the cooling water. The cooling water, temperature of which rose due to the heat conduction, flows outside the compressor 100 via the communicating passage, which is not shown.

In the conventional scroll type compressor, as shown in FIG. 7, parts of the compression chambers 106 are adjacent to the cooling chamber 120 via the fixed scroll base plate 107. Therefore, the cooling water in the cooling chamber 120 warms the gas just flowed into outermost compression chambers.

Since the temperature of the suction gas has not risen yet, the temperature of the cooling water may be higher than the temperature of the suction gas. Therefore, in the conventional scroll type compressor, the cooling water warms the suction gas in the outermost compression chambers.

As the gas just flowed into the outermost compression chambers is warmed, the temperature of the compressed gas, or the temperature of the discharge gas, rises. As the temperature of the gas increased, density of the gas decreases. Therefore, mass flow of the gas (kg/hour) decreases. Consequently, compression efficiency decreases.

In the use of the discharged gas, predetermined mass of the gas should be ensured for unity time. Since mass of discharge air affects the amount of electricity generated by a fuel cell, for example, when the discharged air is used as an oxidizer, the fuel cell requires predetermined mass of the discharged air. In such a state, increasing a workload of the compressor can ensure enough mass flow of the discharged air. However, increasing the workload of the compressor causes the motor for driving the compressor to become large.

SUMMARY OF THE INVENTION

The present invention addresses the above-mentioned problems traceable to a loss of compression efficiency by restraining unwanted heat conduction.

According to the present invention, a scroll type compressor has a housing, a drive shaft, a fixed scroll member, a movable scroll member, a suction port and a discharge port. The drive shaft is rotatably supported by the housing. The fixed scroll member is fixed to the housing. The movable scroll member is accommodated in the housing, and faces the fixed scroll member. The housing and the fixed scroll member define a cooling region. The fixed scroll member and the movable scroll member define a compression region. The gas introduced via the suction port is compressed in the compression region by orbiting the movable scroll member relative to the fixed scroll member by rotation of the drive shaft, and the compressed gas is discharged from the compression region via the discharge port. Heat resistant means is disposed at least between the cooling region and the compression region. Heat resistance of the heat resistant means adjacent to the outermost compression region is greater than that of the heat resistant means adjacent to the innermost compression region.

The greater heat resistance of the outer heat resistant means relative to the heat resistance of the inner heat resistant means inhibits the suction gas from being warmed by coolant, such as cooling water, in the cooling region. Thereby, the temperature of the discharge gas is decreased.

Additionally, the term of the heat resistance in the present invention is a parameter indication the degree how heat is not conducted. Heat resistance is expressed by $\Delta T/Q[K/W]$ where $\Delta T$ is temperature differential between two points, the unit of which is Kelvin, or K. Q is the quantity of heat conduction, the unit of which is watt, or W. In the present invention, heat of the cooling region is conducted to the outermost compression region of the scroll type compressor. In terms of the heat conduction, heat resistance $\alpha$ is expressed by $\alpha-(T1-T2)/Q=\delta/(\lambda \cdot A)$ where T1 and T2 are temperature of both inner and outer surfaces of a solid wall, A is a cross section area of the solid wall. $\delta$ is the thickness of the solid wall. Q is the quantity of transferred heat. Then, $\lambda$ is the heat conductivity.

Other aspects and advantages of the invention will become apparent from the following description, taken in conjunction with the accompanying drawings, illustrating by way of example the principles of the invention.

BRIEF DESCRIPTION OF THE DRAWING

The features of the present invention that are believed to be novel are set forth in the appended claims, specification and accompanying drawings. The invention together with other objects and advantages thereof, may best be understood by reference to the following description of the presently preferred embodiments together with the accompanying drawings in which:

DETAILED DESCRIPTION OF THE PREFERRED EMBODIMENTS

Embodiments of the present invention will now be described with reference to FIGS. 1 through 6. The left side and the right side in FIGS. 1, 4 to 6 correspond to the front end and the rear end, respectively. In the present invention, the heat resistance of a heat resistant means adjacent to outermost compression chambers between a cooling chamber and compression chambers, or on outer heat resistant means, is greater than that of the heat resistant means adjacent to the innermost compression chambers, or an inner heat resistant means. According to the expression $\alpha=(T1-T2)/Q=\delta/(\lambda\cdot A)$, there are three ways to increase the heat resistance as follows: 1) reducing heat conductivity $\lambda$; 2) reducing the cross section are A of a solid wall; and 3) increasing the thickness $\delta$ of the solid wall. The heat resistance of the outer heat resistant means may be increased by applying at least one of three ways.

Figure 1:
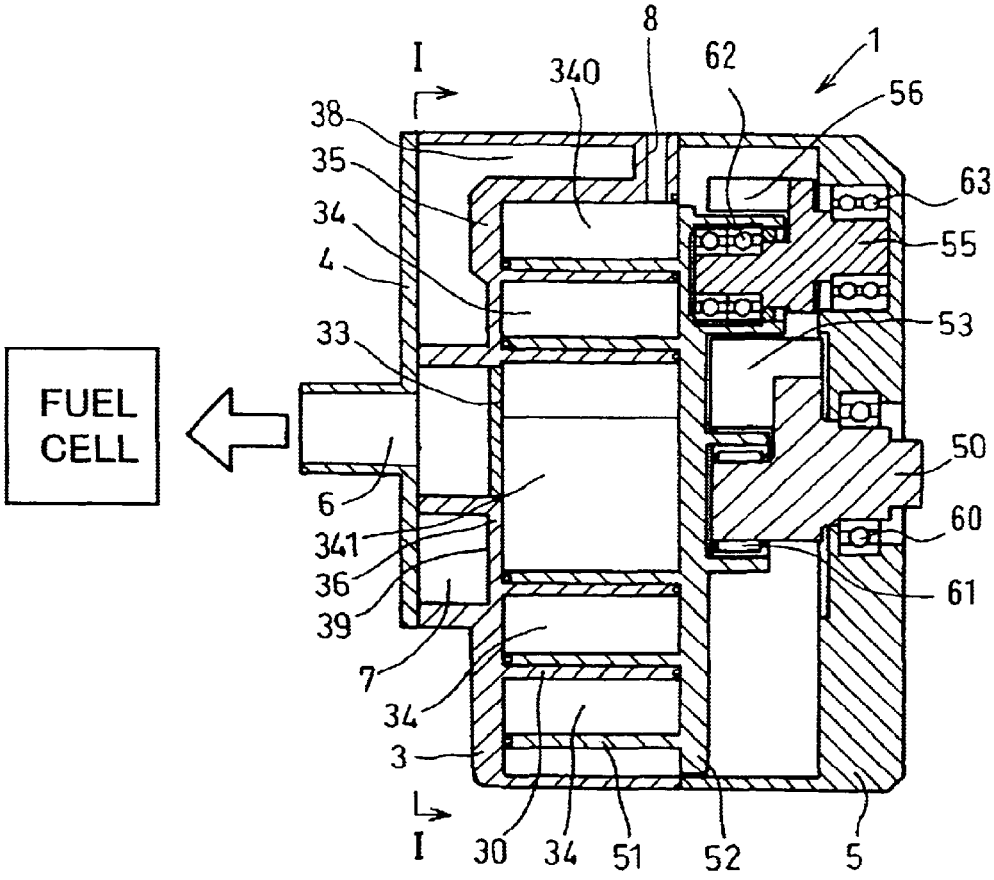
FIG. 1 is a longitudinal cross-sectional view of a scroll type compressor according to a first embodiment of the present invention.

FIG. 1 is a longitudinal cross-sectional view of a scroll type compressor according to a first embodiment of the present invention. The scroll type compressor 1 in the present embodiment is used for compressing air supplied to a fuel cell. The compressor 1 is driven by a motor, which is not shown. A housing of the compressor 1 is constituted of a front casing 3, an end plate 4 and a rear casing 5. A recess 39 is formed on a fixed scroll base plate 36 adjacent to a discharge port 6 formed through the center of the end plate 4 in the front casing 3. The end plate 4 is connected to the front casing 3 on the side of the discharge port 6. The rear casing 5 is connected to the front casing 3. The front casing 3, the end plate 4 and the rear casing 5 are made of an aluminum alloy.

A fixed scroll wall 30 in the front casing 3 extends from the fixed scroll base plate 36 toward the motor. A fixed scroll member includes the fixed scroll wall 30 and the fixed scroll base plate 36. A discharge valve 33 is arranged on the center of the fixed scroll base plate 36 such that the discharge valve 33 opens toward the discharge port 6 only. The discharge port 6 is formed on the front side of the discharge valve 33, and extends through the end plate 4, then communicates with the fuel cell. A cooling chamber 7 is defined between the front casing 3 and the end plate 4.

Figure 2:
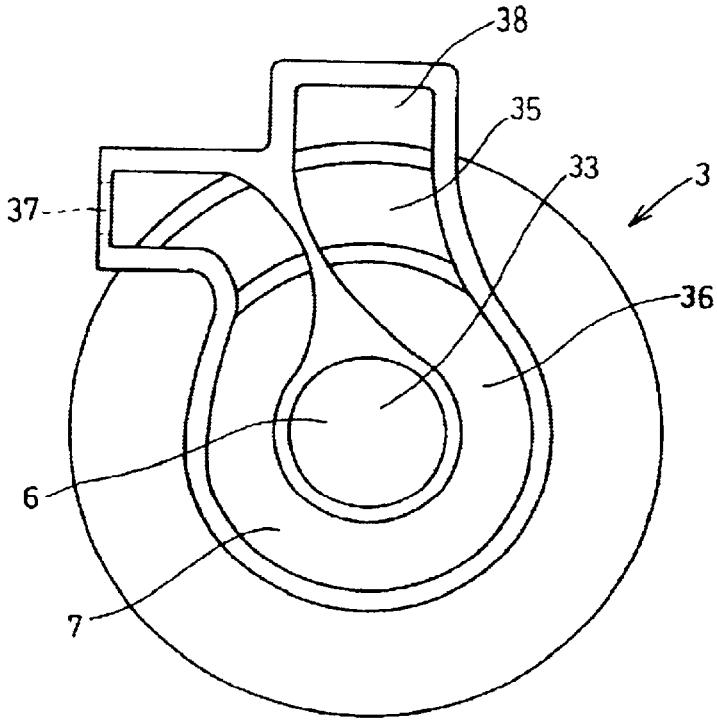
FIG. 2 is a cross-sectional end view taken along line I—I in FIG. 1.
Figure 3:
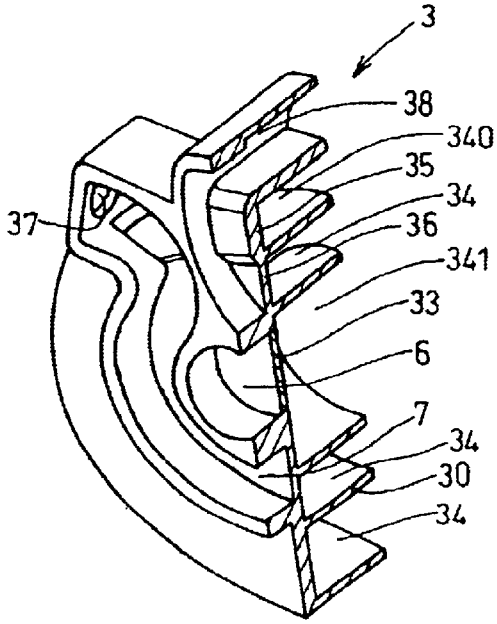
FIG. 3 is a partial perspective end side view of a scroll type compressor in FIG. 1.

FIG. 2 is a cross-sectional end view taken along line I—I in FIG. 1. FIG. 2 is the front end view of the front casing 3. As shown in FIG. 2, the cooling chamber 7 surrounds the discharge port 6, and is U-shaped. The cooling chamber 7 communicates with a communicating passage 38 as an outlet for cooling water. The communicating passage 38 is formed along the outside periphery of the compression chambers 34, and extends to another cooling chamber for cooling the motor. The cooling water flows through the communicating passage 38. A thick portion 35 is provided between the cooling chamber 7 and outermost compression chambers 340. As shown in FIG. 3, the outermost compression chambers 340 are defined on the rear side of the thick portion 35. In the present embodiment, a part of the front casing 3 between the cooling chamber 7 and the compression chambers 34 provides the thick portion 35.

The cooling chamber 7 provides a coolant inlet 37 for introducing the cooling water, and the communicating passage 38 for discharging the cooling water. The cooling chamber 7 constitutes a part of cooling circuit. A radiator, which is not shown, is disposed in the cooling circuit, and cools the heated cooling water discharged from the communicating passage 38. A pump, which is not shown, is also disposed in the cooling circuit, and pumps the cooled cooling water into the coolant inlet 37. Besides, water produced due to a chemical reaction in the fuel cell is used as the cooling water, which circulates in the cooling circuit.

A crank-shaped drive shaft 50 is rotatably supported by the rear casing 5 via a ball bearing 60. A disk-shaped movable scroll base plate 52 is rotatably connected to the front end of the drive shaft 50 via a bearing 61. A balance weight 53 is also arranged on the front end of the drive shaft 50 so as to keep a balance upon rotating the drive shaft 50. The movable scroll wall 51 extends from the movable scroll base plate 52 toward the fixed scroll base plate 36. The rear end of the drive shaft 50 is connected to a drive shaft of the motor, which is not shown. The fixed scroll wall 30 extends from the fixed scroll base plate 36 constituting the front casing 3, and the distal end of the fixed scroll wall 30 contacts with the movable scroll base plate 52. Meanwhile, the distal end of the movable scroll wall 51 contacts with the fixed scroll base plate 36. The fixed scroll wall 30 and the movable scroll wall 51 are arranged between the fixed scroll base plate 36 and the movable scroll base plate 52 symmetrically to the center of the fixed scroll base plate 36 such that the fixed scroll wall 30 wraps over the movable scroll wall 51 by rotating in a half circle. The fixed scroll base plate 36, the fixed scroll wall 30, the movable scroll base plate 52 and the movable scroll wall 51 define the compression chambers 34. A rotary shaft 55 is rotatably connected to the movable scroll base plate 52 via a ball bearing 62. The rotary shaft 55 is also crank-shaped as well as the drive shaft 50, and a balance weight 56 is arranged on the rotary shaft 55. Also, the rotary shaft 55 is rotatably supported by the rear casing 5 via a ball bearing 63.

As the motor, which is not shown, drives the drive shaft 50, the movable scroll base plate 52 orbits relative to the center of the drive shaft 50. The movable scroll wall 51 also orbits along the fixed scroll wall 30. Besides, the rotary shaft 55 retards the self rotation of the movable scroll wall 51.

As the movable scroll wall 51 starts orbiting, air is introduced from an inlet 8 and flows into the outermost compression chambers 340 communicating with the inlet. In the compression chambers 34, as the air is radially inwardly moved toward the center of the fixed scroll wall 30, the air is compressed. The compressed air reaches an innermost compression chamber 341, and is discharged through the discharge valve 33 and the discharge port 6, then supplied to the fuel cell.

The cooling water flows into the cooling chamber 7 through the coolant inlet 37. The cooling water in the cooling chamber 7 absorbs heat generated by compressing the air in the compression chambers 34, and flows outside through the communicating passage 38. Then, the cooling water is cooled in a radiator, which is not shown, and flows into the cooling chamber 7 again due to a pump, which is not shown. That is, the cooling water circulates in the cooling circuit as repeatedly increases and decreases its temperature. Part of the cooling water discharged from the communicating passage 38 is discarded, and water produced due to a chemical reaction in the fuel cell is supplied to the cooling circuit when necessary.

The thick portion 35, that is, the outer heat resistant means in the present embodiment, is integrally formed by casting the housing of the compressor 1 in a mold.

In the present embodiment, the heat resistant means is constructed by adjusting the thickness of a part of the front casing 3 between the cooling chamber 7 and the compression chambers 34 such that the heat resistance of the outer heat resistant means is greater than that of the inner heat resistant means. The above-mentioned 3) is applied in this case.

The heat resistance of the outer heat resistant means is greater than that of the inner heat resistant means. In other words, the thick portion 35 provided between the cooling chamber 7 and the outermost compression chambers 340 is at least thick than the fixed scroll base plate 36 adjacent to the discharge port 6 between the cooling chamber 7 and the compression chambers 34.

Figure 4:
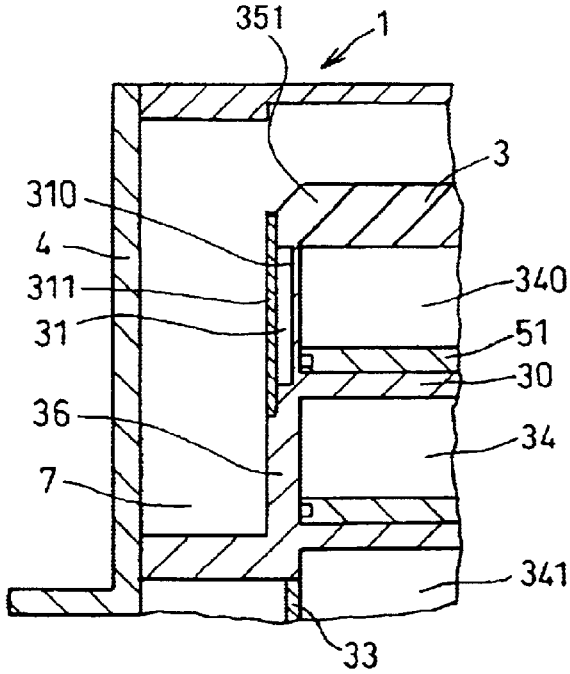
FIG. 4 is an enlarged partial longitudinal cross-sectional view of a scroll type compressor with a closed-structure air chamber according to the second embodiment of the present invention.

A second embodiment of the present invention will now be described with reference to FIG. 4. The same reference numerals denote the similar components in FIG. 1.

According to the second embodiment, a recess 310 is formed on the fixed scroll base plate 36 adjacent to the outermost compression chambers 340. A flat plate 311 is disposed on the front end of the fixed scroll base plate 36 so as to close the recess 310, and the recess 310 closed by the flat plate 311 is defined as an air chamber 31. A rubber member, which is not shown, is inserted between the front casing 3 and the flat plate 311. Thereby, the rubber member retards the cooling water inside the cooling chamber 7 from flowing into the air chamber 31. Also, a thick portion 351 is provided at the front casing 3 between the cooling chamber 7 and the outermost compression chambers 340.

When the front casing 3 is cast in a mold, the recess 310 and the thick portion 351 are formed at the same time. The flat plate 311 closes the recess 310 after casting, thus defining the air chamber 31. The other components of the compressor 1 in the present embodiment are the same as those in the first embodiment.

In the present embodiment, the outer heat resistant means provides the air chamber 31 formed within the fixed scroll base plate 36 adjacent to the outermost compression chambers 340 and the thick portion 351 at the front casing 3 between the cooling chamber 7 and the outermost compression chambers 340. The above-mentioned 1) and 3) are applied in this case. Heat conductivity of air is smaller than heat conductivity of a material such as cast iron and an aluminum alloy. Therefore, heat resistance of the outer heal resistant means is increased by providing the air chamber 31 and the thick portion 351.

Figure 5:
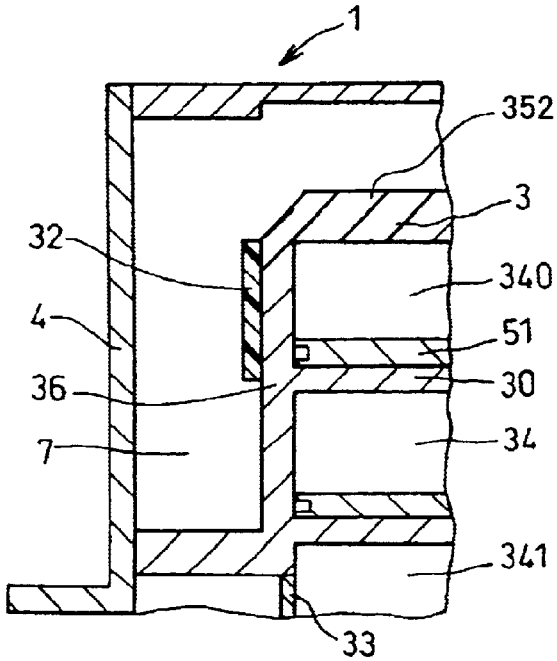
FIG. 5 is an enlarge partial longitudinal cross-sectional view of a scroll type compressor according to a third embodiment of the present invention.
Figure 4A:
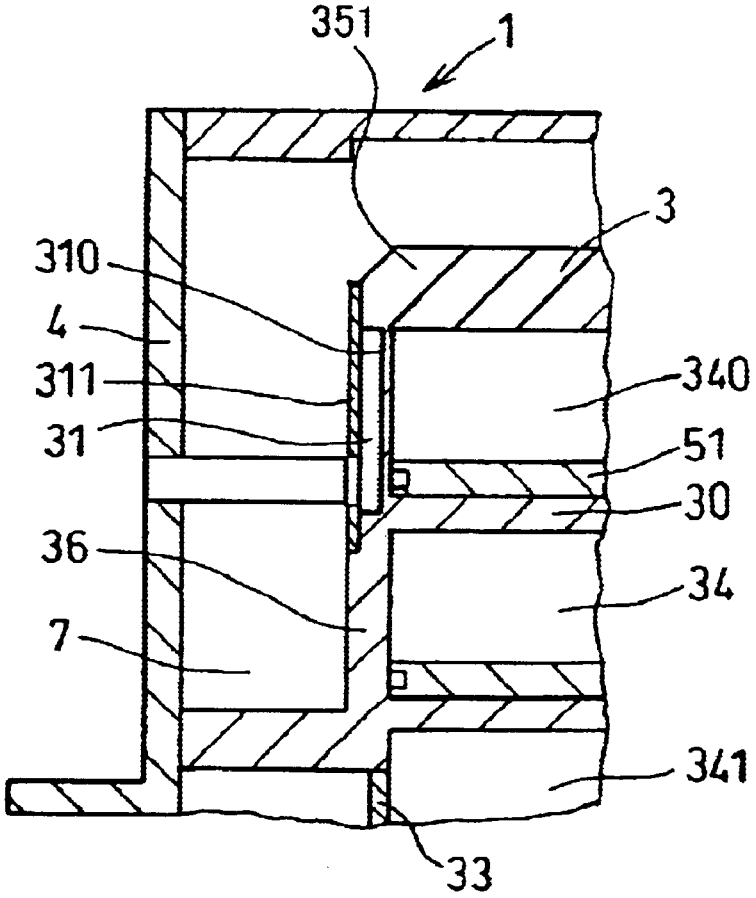
FIG. 4A is an enlarged partial longitudinal cross-sectional view of a scroll type compressor with an open-structure air chamber according to another embodiment of the present invention.
Figure 6:
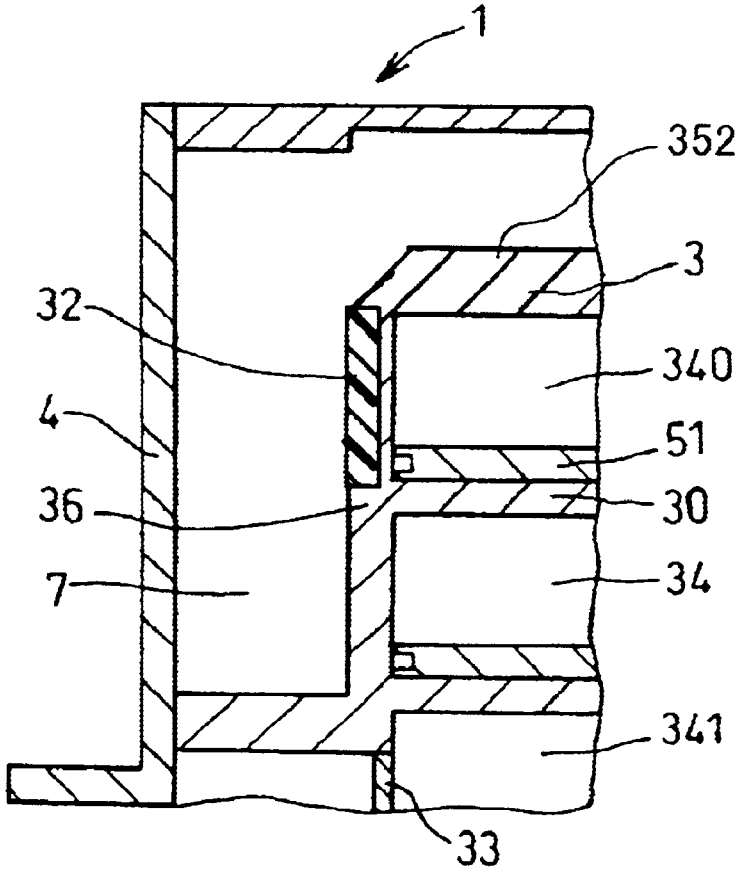
FIG. 6 is an enlarged partial longitudinal cross-sectional view of a scroll type compressor according to the third embodiment of the present invention.
Figure 7:
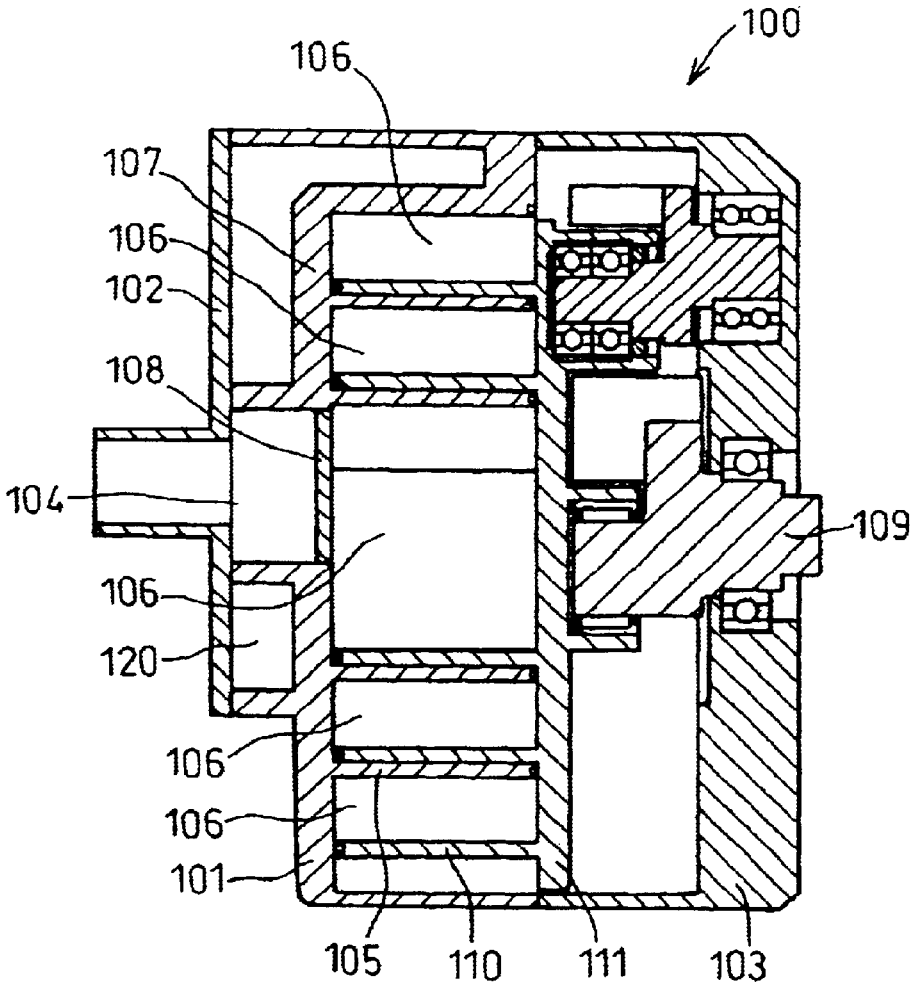
Fig. 7 (PRIOR ART)
FIG. 7 is a longitudinal cross-sectional view of a conventional scroll type compressor.

A third embodiment of the present invention will now be described with reference to FIGS. 5 and 6. The same reference numerals denote the similar components in FIG. 1.

According to the third embodiment, a heat insulating member 32 is bonded on the fixed scroll base plate 36 adjacent to the outermost compression chambers 340 after casting the housing of the compressor 1. Also, a thick portion 352 is provided at the front casing 3 between the cooling chamber 7 and the outermost compression chambers 340.

When the front casing 3 is cast in a mold, the thick portion 352 is formed at the same time. The other components of the compressor 1 in the present embodiment are the same as those in the first embodiment.

In the present embodiment, the outer heat resistant means provides the heat insulating member 32 on the fixed scroll base plate 36 adjacent to the outermost compression chambers 340 and the thick portion 352 at the front casing 3 between the cooling chamber 7 and the outermost compression chambers 340. The above-mentioned 1) and 3) are applied in this case. Accordingly, heat resistance of the outer heat resistant means is increased by providing the heat insulating member 32 and the thick portion 352.

The present invention is not limited to the embodiments described above, but may be modified into the following examples.

A method of making thick portions 35, 351, 352 is not limited. For example, the thick portions 35 351, 352 are formed upon casting the front casing 3. Also, the thick portions 35, 351, 352 may be formed by grinding the fixed scroll base plate 36 adjacent to the discharge port 6.

If the heat resistance of the outer heat resistant means is greater than that of the inner heat resistant means, the shape of a cross section of the heat resistant means is not limited. For example, the thickness of the heat resistant means gradually radially outwardly increases. Also, the thickness of the heat resistant means is terraced, and radially outwardly increases.

The size, number, and shape of the air chamber 31 are not limited. For example, the single air chamber 31 may be formed within a part of the front casing 3 between the cooling chamber 7 and the outermost compression chambers 340. Also, a plurality of the air chambers 31 may be formed within a part of the front casing 3 between the cooling chamber 7 and the outermost compression chambers 340.

The structure of the air chamber 31 is not limited. The structure of the air chamber 31 may be closed and airtight, or may be open and communicant with the outside of the compressor 1. Air in the air chamber 31 is warmed by the heated cooling water's and expands with heat. The closed structure requires considering pressure-resistance of the air chamber 31. Meanwhile, the open structure does not require considering pressure-resistance of the air chamber 31 because the expanded air in the air chamber 31 may escape outside the compressor. Additionally, as the air escapes outside the compressor, the heat generated in the air chamber 31 is also diffused outside the compressor. Thereby, the outermost compression chambers 340 are further inhibited from being warmed.

When heat resistance of a material of the heat insulating member 32 is greater than that of the fixed scroll base plate 36, and when the material resists the temperature of the service environment of the compressor 1, any materials may be available. For example, glass wool, rock wool, asbestos and foamed plastics may be used as the heat insulating member 32. The size, number, and shape of the heat insulating member 32 are not limited. Additionally, a method of disposing the heat insulating member 32 is not limited. For example, the heat insulating member 32 may be bonded on a part of the front casing 3 adjacent to the outermost compression chambers 340 after casting the housing of the compressor 1.

A position for bonding the heat insulating member 32 is not limited. The position may be one of the surfaces of the front casing 3 between the cooling chamber 7 and the outermost compression chambers 340. Also, the heat insulating member 32 may be disposed within the front casing 3 between the cooling chamber 7 and the outermost compression chambers 340.

The scroll type compressor of the present invention is suited for compressing gas supplied to the fuel cell. An electric vehicle driven due to the fuel cell is highly expected in the automobile industry. The scroll type compressor is the focus of the attention for the use of compressing the gas supplied to the fuel cell because of its small and lightweight structure.

A predetermined mass of gas should be ensured for unit time in some situations upon using the discharged gas. Since the mass of discharged air affects the amount of electricity generated by the fuel cell when the discharged air is used as an oxidizer, the fuel cell requires the predetermined mass of gas corresponding to the electricity generated by the fuel cell. According to the scroll type compressor of the present invention, as the temperature of the gas discharged from the compressor, that is, the temperature of the gas supplied to the fuel cell decreases, the mass flow of the gas increases. Accordingly, the desired mass flow of the gas may be supplied to the fuel cell.

Additionally, gas needs to be humidified before the chemical reaction in the fuel cell starts. Therefore, the hydrogen ion exchange membrane for humidifying the gas is arranged around the discharge port of the compressor, and the heat-resistant temperature of the hydrogen ion exchange membrane is about 140° C. Also, the heat-resistant temperatures of some members constituting the fuel cell are about 100° C. Supplied to the fuel cell, the gas needs to be previously cooled in the compressor so as to meet the requirements of the heat-resistant temperatures of members. According to the scroll type compressor of the present invention, the gas supplied to the fuel cell is cooled so as to meet the requirements. Therefore, the fuel cell and its equipments are free from heat.

Besides, air, oxygen as oxidizers, and hydrogen as fuel are used as the gases supplied to the fuel cell. The scroll type compressor of the present invention may compress those gases.

According to the present invention, the scroll type compressor discharges the gas in low temperature.

The present examples and embodiments are to be considered as illustrative and not restrictive and the invention is not to be limited to the details given herein but may be modified within the scope of the appended claims.

What is claimed is:

1. A scroll type compressor comprising:

a housing;

a drive shaft rotatably supported by the housing;

a fixed scroll member fixed to the housing, the housing and the fixed scroll member defining a cooling region;

a movable scroll member accommodated in the housing, facing the fixed scroll member, the fixed scroll member and the movable scroll member defining a compression region;

a suction port for introducing gas into the compressor;

a discharge port for discharging the gas;

wherein the gas introduced via the suction port is compressed in the compression region by orbiting the movable scroll member relative to the fixed scroll member by rotation of the drive shaft, and the compressed gas is discharged from the compression region via the discharge port;

a heat resistant means disposed at least between the cooling region and the compression region; and wherein heat resistance of the heat resistant means adjacent to the outermost compression region is greater than that of the heat resistant means adjacent to the innermost compression region.

2. The scroll type compressor according to claim 1, wherein the heat resistant means is a part of the housing between the cooling region and the compression region, and the heat resistant means adjacent to the outermost compression region is thicker than the heat resistant means adjacent to the innermost compression region.

3. The scroll type compressor according to claim 1, wherein the thickness of the heat resistant means radially outwardly increases.

4. The scroll type compressor according to claim 1, wherein the heat resistant means is the housing between the cooling region and the compression region, and the heat resistant means adjacent to the outermost compression region includes an air chamber.

5. The scroll type compressor according to claim 4, wherein the air chamber is closed structure.

6. The scroll type compressor according to claim 4, wherein the air chamber is open structure.

7. The scroll type compressor according to claim 1, wherein the heat resistant means is the housing between the cooling region and the compression region, and the heat resistant means adjacent to the outermost compression region includes a heat insulating member.

8. The scroll type compressor according to claim 7, wherein the heat insulating member is one of glass wool, rock wool, asbestos, and foamed plastics.

9. The scroll type compressor according to claim 1, wherein the gas is supplied to the fuel cell.

10. The scroll type compressor according to claim 1, wherein heat resistance of the heat resistant means adjacent to the outermost compression region on the side of an outlet for cooling water in the cooling region is greater than that of the heat resistant means other than the former.

* * * * *